US009721520B2

(12) United States Patent
Cao

(10) Patent No.: US 9,721,520 B2
(45) Date of Patent: Aug. 1, 2017

(54) GOA CIRCUIT AND A LIQUID CRYSTAL DISPLAY

(71) Applicants: Shenzhen China Star Optoelectronics Technology Co., Ltd., Shenzhen, Guangdong (CN); Wuhan China Star Optoelectronics Technology Co., Ltd., Wuhan, Hubei (CN)

(72) Inventor: Shangcao Cao, Guangdong (CN)

(73) Assignees: Shenzhen China Star Optoelectronics Technology Co., Ltd, Shenzhen, Guangdong (CN); Wuhan China Star Optoelectronics Technology Co., Ltd, Wuhan, Hubei (CN)

( * ) Notice: Subject to any disclaimer, the term of this patent is extended or adjusted under 35 U.S.C. 154(b) by 128 days.

(21) Appl. No.: 14/786,088

(22) PCT Filed: Sep. 23, 2015

(86) PCT No.: PCT/CN2015/090352
§ 371 (c)(1),
(2) Date: Oct. 21, 2015

(87) PCT Pub. No.: WO2017/045220
PCT Pub. Date: Mar. 23, 2017

(65) Prior Publication Data

US 2017/0162151 A1 Jun. 8, 2017

(30) Foreign Application Priority Data

Sep. 17, 2015 (CN) ..... 2015 1 0594063

(51) Int. Cl.
*G09G 3/36* (2006.01)

(52) U.S. Cl.
CPC ..... *G09G 3/3677* (2013.01); *G09G 3/3696* (2013.01); *G09G 2300/0426* (2013.01);
(Continued)

(58) Field of Classification Search
CPC ..... G09G 3/3677; G09G 3/3696; G09G 2300/0809; G09G 2300/0426; G09G 2310/08; G09G 2310/0213
See application file for complete search history.

(56) References Cited

U.S. PATENT DOCUMENTS

2008/0122829 A1* 5/2008 Park ..... G09G 3/3677 345/213
2008/0136756 A1* 6/2008 Yeo ..... G09G 3/3677 345/87

(Continued)

*Primary Examiner* — Ibrahim Khan
(74) *Attorney, Agent, or Firm* — Andrew C. Cheng

(57) ABSTRACT

The application disclosure a GOA circuit and a liquid crystal display. The GOA circuit including a plurality of GOA unit connected in series, wherein a Nth level GOA unit including a fifth transistor, a eighth transistor and a leakage control module. wherein the leakage control module is connected in series between the Nth level gate terminal signal and the drain terminal of the eighth transistor and/or between the Nth level pull-down signal and the drain terminal of the fifth transistor; in the valid period of the Nth level scanning signal can block the Nth level gate terminal signal through the leakage pathway of the eighth transistor and/or to block the Nth level pull-down signal through the leakage pathway of the fifth transistor to achieve the stability of the GOA circuit.

20 Claims, 4 Drawing Sheets

(52) U.S. Cl.
CPC ..... *G09G 2300/0809* (2013.01); *G09G 2310/0213* (2013.01); *G09G 2310/08* (2013.01)

(56) References Cited

U.S. PATENT DOCUMENTS

| | | | | |
|---|---|---|---|---|
| 2008/0278214 | A1* | 11/2008 | Yoon | G09G 3/3677 327/379 |
| 2010/0079443 | A1* | 4/2010 | Chang | G09G 3/3677 345/214 |
| 2010/0207928 | A1* | 8/2010 | Lee | G09G 3/3677 345/213 |
| 2010/0309191 | A1* | 12/2010 | Hsu | G11C 19/28 345/213 |
| 2014/0103983 | A1* | 4/2014 | Chang | G09G 3/3655 327/198 |
| 2016/0018844 | A1* | 1/2016 | Sasaki | G11C 19/28 713/600 |
| 2016/0019828 | A1* | 1/2016 | Lin | G09G 3/20 345/214 |
| 2016/0042691 | A1* | 2/2016 | Na | G11C 19/28 345/205 |

* cited by examiner

GOA CIRCUIT AND A LIQUID CRYSTAL DISPLAY

FIELD OF THE INVENTION

The present invention relates to the field of liquid crystal display technology, and in particular to a GOA circuit structure.

BACKGROUND

Nowadays, in order to fill the requirement of the narrow bezel or zero bezel of the liquid crystal display, the Indium-Gallium-Zinc Oxidethin film transistor (IGZO TFT) is usually used on the gate driver on array (GOA). Since the IGZO TFT has lower threshold voltage (Vth) and lower subthreshold swing (SS). When the gate-source voltage (Vgs) is zero, the IGZO TFT still cannot close normally. The larger leakage will decrease the stability of the GOA circuit and increase the power loss of the GOA circuit.

SUMMARY OF THE INVENTION

AGOA circuit and a liquid crystal display are provided in this application to solve the technical problem of blocking the leakage pathway of the IGZO TFT in GOA circuit to achieve the stability of the GOA circuit.

In order to solve the technical problem, the technical approach of this application is: providing a GOA circuit for liquid crystal display wherein the GOA circuit including a plurality of GOA unit connected in series, wherein a Nth level GOA unit including a pull-up control module, a pull-down module, a pull-up module, a pull-down holding module and a leakage control module; the pull-up control module including a first transistor, a gate terminal of the first transistor is connected to a N-1th level pull-down signal, a drain terminal of the first transistor is connected to the first leakage control signal and the source terminal of the first transistor is connected to the Nth levelgate terminal signal; the pull-down module including a second transistor, the gate terminal of the second transistor is connected to the Nth levelgate terminal signal, the drain terminal of the second transistor is connected to the Nth level clock signal line, and the source terminal of the second transistor output the Nth level pull-down signal; the pull-up module including a third transistor, the gate terminal of the third transistor is connected to the Nth levelgate terminal signal, the drain terminal of the third transistor is connected to the Nth level clock signal line, and the source terminal of the third transistor output the Nth level scanning signal; the pull-down holding module including a fifth transistor and a eighth transistor, the gate terminal of the fifth transistor is connected to the Nth level common signal, the drain terminal of the fifth transistor is connected to the Nth level pull-down signal, the source terminal of the fifth transistor is connected to a first low direct current voltage source; and the gate terminal of the eighth transistor is connected to the Nth level common signal, the source terminal of the eighth transistor is connected to the first low direct current voltage source and the drain terminal of the eighth transistor is connected to the Nth levelgate terminal signal; the leakage control module is connected in series between the Nth level gate terminal signal and the eighth transistor and/or between the Nth level pull-down signal and the fifth transistor; in the valid period of the Nth level scanning signal, a second leakage control signal is to block the Nth level gate terminal signal through the leakage pathway of the eighth transistor and/or to block the Nth level pull-down signal through the leakage pathway of the fifth transistor; wherein the leakage control module including a fourth transistor and a seventh transistor, the gate terminal of the fourth transistor is connected to the second leakage control signal, the drain terminal of the fourth transistor is connected to the direct current signaling source, the source terminal of the fourth transistor is connected to the drain terminal of the eighth transistor; the seventh transistor is connected between the Nth levelgate terminal signal and the drain terminal of the eighth transistor, the gate terminal of the seventh transistor is connected to the Nth level common signal, the drain terminal of the seventh transistor is connected to the Nth levelgate terminal signal and the source terminal of the seventh transistor is connected to the drain terminal of the eighth transistor to block the Nth levelgate terminal signal through the leakage pathway of the eighth transistor in the valid period of the Nth level scanning signal. Wherein the first leakage control signal is the N−1th levelgate terminal signal to block the Nth levelgate terminal signal through the leakage pathway of the first transistor in the valid period of the Nth level scanning signal.

wherein the second leakage control signal is the Nth level pull-down signal.

In order to solve the technical problem, the another technical approach of this application is: providing a GOA circuit for liquid crystal display wherein the GOA circuit including a plurality of GOA unit connected in series, wherein a Nth level GOA unit including a pull-up control module, a pull-down module, a pull-up module, a pull-down holding module and a leakage control module; the pull-up control module including a first transistor, a gate terminal of the first transistor is connected to a N−1th level pull-down signal, a drain terminal of the first transistor is connected to the first leakage control signal and the source terminal of the first transistor is connected to the Nth levelgate terminal signal; the pull-down module including a second transistor, the gate terminal of the second transistor is connected to the Nth levelgate terminal signal, the drain terminal of the second transistor is connected to the Nth level clock signal line, and the source terminal of the second transistor output the Nth level pull-down signal; the pull-up module including a third transistor, the gate terminal of the third transistor is connected to the Nth levelgate terminal signal, the drain terminal of the third transistor is connected to the Nth level clock signal line, and the source terminal of the third transistor output the Nth level scanning signal; the pull-down holding module including a fifth transistor and a eighth transistor, the gate terminal of the fifth transistor is connected to the Nth level common signal, the drain terminal of the fifth transistor is connected to the Nth level pull-down signal, the source terminal of the fifth transistor is connected to a first low direct current voltage source; and the gate terminal of the eighth transistor is connected to the Nth level common signal, the source terminal of the eighth transistor is connected to the first low direct current voltage source and the drain terminal of the eighth transistor is connected to the Nth levelgate terminal signal. The leakage control module is connected in series between the Nth level gate terminal signal and the eighth transistor and/or between the Nth level pull-down signal and the fifth transistor; a second leakage control signal is to block the Nth level gate terminal signal through the leakage pathway of the eighth transistor and/or to block the Nth level pull-down signal through the leakage pathway of the fifth transistor in the valid period of the Nth level scanning signal.

wherein the leakage control module including a fourth transistor and a seventh transistor, the gate terminal of the fourth transistor is connected to the second leakage control signal, the drain terminal of the fourth transistor is connected to the direct current signaling source, the source terminal of the fourth transistor is connected to the drain terminal of the eighth transistor; the seventh transistor is connected between the Nth levelgate terminal signal and the drain terminal of the eighth transistor, the gate terminal of the seventh transistor is connected to the Nth level common signal, the drain terminal of the seventh transistor is connected to the Nth levelgate terminal signal and the source terminal of the seventh transistor is connected to the drain terminal of the eighth transistor to block the Nth levelgate terminal signal through the leakage pathway of the eighth transistor in the valid period of the Nth level scanning signal.

wherein the second leakage control signal is the Nth level pull-down signal. wherein the second leakage control signal is the N−1th level gate terminal signal. wherein the leakage control module further including a sixth transistor, wherein the sixth transistor is connected between the Nth level pull-down signal and the drain terminal of the fifth transistor, the gate terminal of the sixth transistor is connected to the Nth level common signal, the drain terminal of the sixth transistor is connected to the Nth level pull-down signal, the source terminal of the sixth transistor is connected to the drain terminal of the fifth transistor and the source terminal of the fourth transistor to block the Nth level pull-down signal through the leakage pathway of the fifth transistor in the valid period of the Nth level scanning signal.

wherein the first leakage control signal is the N−1th level gate terminal signal to block the Nth levelgate terminal signal through the leakage pathway of the first transistor in the valid period of the Nth level scanning signal.

wherein the Nth level GOA unit further including a pull-down module, the pull-down module including a ninth level transistor, a tenth level transistor, an eleventh level transistor, a twelfth transistor, a thirteenth level transistor and a fourteenth level transistor; wherein the gate terminal of the ninth level transistor is connected to the Nth level pull-down signal, the source terminal of the ninth level transistor is connected to the a second low direct current voltage source, the drain terminal of the ninth level transistor is connected to the Nth level common signal, the gate terminal of the tenth level transistor is connected to the N−1th level pull-down signal, the source terminal of the tenth level transistor is connected to the second low direct current voltage source, the drain terminal of the tenth level transistor is connected to the Nth level common signal, the gate terminal of the eleventh level transistor is connected to the N−1th level pull-down signal, the source terminal of the eleventh level transistor is connected to the second low direct current voltage source, the drain terminal of the eleventh level transistor is connected to the source terminal of the twelfth transistor, the gate terminal of the twelfth transistor is connected to the N−1th level clock signal line, the drain terminal of the twelfth transistor is connected to the gate terminal of the thirteenth level transistor and the source terminal of the fourteenth level transistor, the source terminal of the thirteenth level transistor is connected to the Nth level common signal, the drain terminals of the thirteenth level transistor and the fourteenth level transistor are connected to the direct current signaling source, the gate terminal of the fourteenth transistor is connected to the N+2th level clock signal line.

wherein the electric potential of the first low direct current voltage source is smaller than the electric potential of the second low direct current voltage source, the lower electric potential of the N−1th level pull-down signal, the Nth level pull-down signal are smaller than the electric potential of the of the second low direct current voltage source to block the leakage pathway of the Nth level common signal through the ninth transistor, the tenth transistor, the eleventh transistor in the invalid period of the Nth level scanning signal.

wherein the Nth level GOA unit received a first clock signal, a second clock signal, a third clock signal, and a fourth clock signal, and the first clock signal, the second clock signal, the third clock signal, and the fourth clock signal CK4 are timely valid in orderly during one working period, wherein when the Nth level clock signal line is the first clock signal, the N+2 clock signal line is the third clock signal and the N−1 clock signal line is the fourth clock signal.

In order to solve the technical problem, the another technical approach of this application is: providing a liquid crystal display having a GOA circuit, the GOA circuit including a plurality of GOA unit connected in series, wherein a Nth level GOA unit including a pull-up control module, a pull-down module, a pull-up module, a pull-down holding module and a leakage control module; the pull-up control module including a first transistor, a gate terminal of the first transistor is connected to a N−1th level pull-down signal, a drain terminal of the first transistor is connected to the first leakage control signal and the source terminal of the first transistor is connected to the Nth levelgate terminal signal; the pull-down module including a second transistor, the gate terminal of the second transistor is connected to the Nth levelgate terminal signal, the drain terminal of the second transistor is connected to the Nth level clock signal line, and the source terminal of the second transistor output the Nth level pull-down signal; the pull-up module including a third transistor, the gate terminal of the third transistor is connected to the Nth levelgate terminal signal, the drain terminal of the third transistor is connected to the Nth level clock signal line, and the source terminal of the third transistor output the Nth level scanning signal; the pull-down holding module including a fifth transistor and a eighth transistor, the gate terminal of the fifth transistor is connected to the Nth level common signal, the drain terminal of the fifth transistor is connected to the Nth level pull-down signal, the source terminal of the fifth transistor is connected to a first low direct current voltage source; and the gate terminal of the eighth transistor is connected to the Nth level common signal, the source terminal of the eighth transistor is connected to the first low direct current voltage source and the drain terminal of the eighth transistor is connected to the Nth levelgate terminal signal. The leakage control module is connected in series between the Nth level gate terminal signal and the eighth transistor and/or between the Nth level pull-down signal and the fifth transistor; a second leakage control signal is to block the Nth level gate terminal signal through the leakage pathway of the eighth transistor and/or to block the Nth level pull-down signal through the leakage pathway of the fifth transistor in the valid period of the Nth level scanning signal.

Wherein the leakage control module including a fourth transistor and a seventh transistor, the gate terminal of the fourth transistor is connected to the second leakage control signal, the drain terminal of the fourth transistor is connected to the direct current signaling source, the source terminal of the fourth transistor is connected to the drain terminal of the eighth transistor; the seventh transistor is connected between the Nth levelgate terminal signal and the drain terminal of the eighth transistor, the gate terminal of the seventh transistor is connected to the Nth level common signal, the drain terminal of the seventh transistor is connected to the Nth levelgate terminal signal and the source terminal of the seventh transistor is connected to the drain terminal of the eighth transistor to block the Nth levelgate terminal signal through the leakage pathway of the eighth transistor in the valid period of the Nth level scanning signal.

wherein the second leakage control signal is the Nth level pull-down signal. wherein the second leakage control signal is the N−1th level gate terminal signal. wherein the leakage control module further including a sixth transistor, the sixth transistor is connected between the Nth level pull-down signal and the drain terminal of the fifth transistor, the gate terminal of the sixth transistor is connected to the Nth level common signal, the drain terminal of the sixth transistor is connected to the Nth level pull-down signal, the source terminal of the sixth transistor is connected to the drain terminal of the fifth transistor and the source terminal of the fourth transistor to block the Nth level pull-down signal through the leakage pathway of the fifth transistor in the valid period of the Nth level scanning signal.

wherein the first leakage control signal is the N−1th level gate terminal signal to block the Nth levelgate terminal signal through the leakage pathway of the first transistor in the valid period of the Nth level scanning signal.

wherein the Nth level GOA unit further including a pull-down module, the pull-down module including a ninth transistor, a tenth transistor, an eleventh transistor, a twelfth transistor, a thirteenth transistor and a fourteenth transistor; wherein the gate terminal of the ninth transistor is connected to the Nth level pull-down signal, the source terminal of the ninth transistor is connected to the a second low direct current voltage source, the drain terminal of the ninth transistor is connected to the Nth level common signal, the gate terminal of the tenth transistor is connected to the N−1th level pull-down signal, the source terminal of the tenth transistor is connected to the second low direct current voltage source, the drain terminal of the tenth transistor is connected to the Nth level common signal, the gate terminal of the eleventh transistor is connected to the N−1th level pull-down signal, the source terminal of the eleventh transistor is connected to the second low direct current voltage source, the drain terminal of the eleventh transistor is connected to the source terminal of the twelfth transistor, the gate terminal of the twelfth transistor is connected to the N−1th level clock signal line, the drain terminal of the twelfth transistor is connected to the gate terminal of the thirteenth transistor and the source terminal of the fourteenth transistor, the source terminal of the thirteenth transistor is connected to the Nth level common signal, the drain terminals of the thirteenth transistor and the fourteenth transistor are connected to the direct current signaling source, the gate terminal of the fourteenth transistor is connected to the N+2th level clock signal line.

wherein the electric potential of the first low direct current voltage source is smaller than the electric potential of the second low direct current voltage source, the lower electric potential of the N−1th level pull-down signal, the Nth level pull-down signal are smaller than the electric potential of the of the second low direct current voltage source to block the leakage pathway of the Nth level common signal through the ninth transistor, the tenth transistor, the eleventh transistor in the invalid period of the Nth level scanning signal.

Wherein the Nth level GOA unit received a first clock signal, a second clock signal, a third clock signal, and a fourth clock signal, and the first clock signal, the second clock signal, the third clock signal, and the fourth clock signal CK4 are timely valid in orderly during one working period, wherein when the Nth level clock signal line is the first clock signal, the N+2 clock signal line is the third clock signal and the N−1 clock signal line is the fourth clock signal.

The advantage of this application is by adding the leakage control module between the Nth level gate terminal signal and the eighth transistor and/or the Nth level pull-down signal and the fifth transistor into the GOA circuit and the liquid crystal display structure to achieving of leakage blocking. In the valid period of the Nth level scanning signal, the Nth level gate terminal signal through the leakage pathway from the eighth transistor and/or the leakage pathway through the Nth level pull-down signal through the fifth transistor is blocked and enhance the stability of the GOA circuit.

BRIEF DESCRIPTION OF THE DRAWINGS

The following detailed descriptions accompanying drawings and the embodiment of the present invention make the aspect of the present invention and the other beneficial effect more obvious.

DETAILED DESCRIPTION OF THE PREFERRED EMBODIMENTS

The specific components or items are used in the specification and claims. Those skilled in the art can use other possible modifications and variations in the same components or items. The specification and claim will not distinguish the different terms to the items or components but by the functions. Following is the detail description illustrated by the figures and the embodiments.

Figure 1:
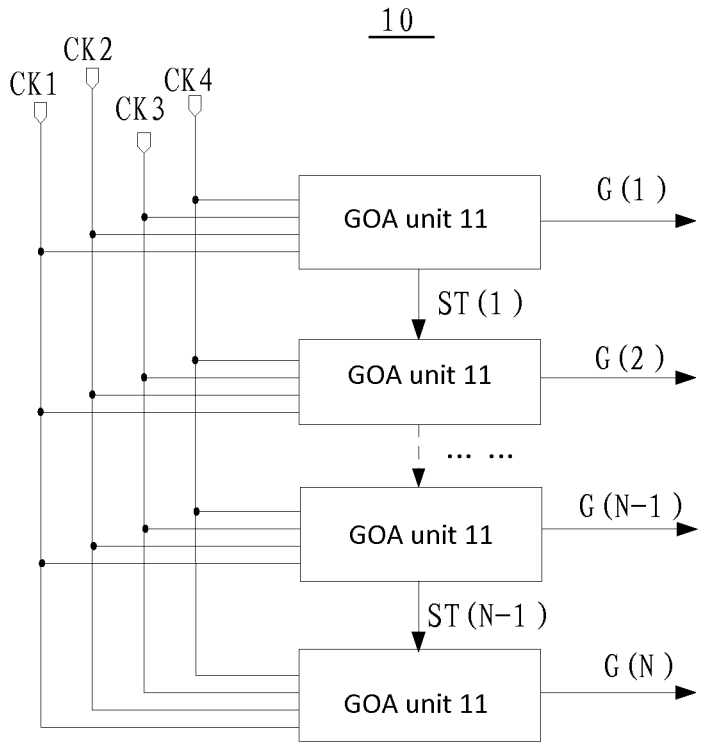
FIG. 1 is a schematic view illustrating the GOA circuit structure according to the present invention.

FIG. 1 is a schematic view illustrating the GOA circuit structure according to the present invention. FIG. 1 illustrates a GOA circuit 10 includes a plurality of GOA unit 11 connected in series. The Nth level GOA unit 11 is used and controlled by the first clock signal CK1, a second clock signal CK2, a third clock signal CK3, a fourth clock signal CK4 and the pull-down signal ST (N−1), output the scanning signal G (N) to charge the Nth level horizontal scanning line in the corresponding display zone. Wherein the first clock signal CK1, the second clock signal CK2, the third clock signal CK3, the fourth clock signal CK4 are timely working accordingly in one valid period, in other words, the first clock signal CK1, the second clock signal CK2, the third clock signal CK3, the fourth clock signal CK4 are in high electrical potential accordingly in one valid period. And the transistors in the GOA circuit are IGZO TFT.

Figure 2:
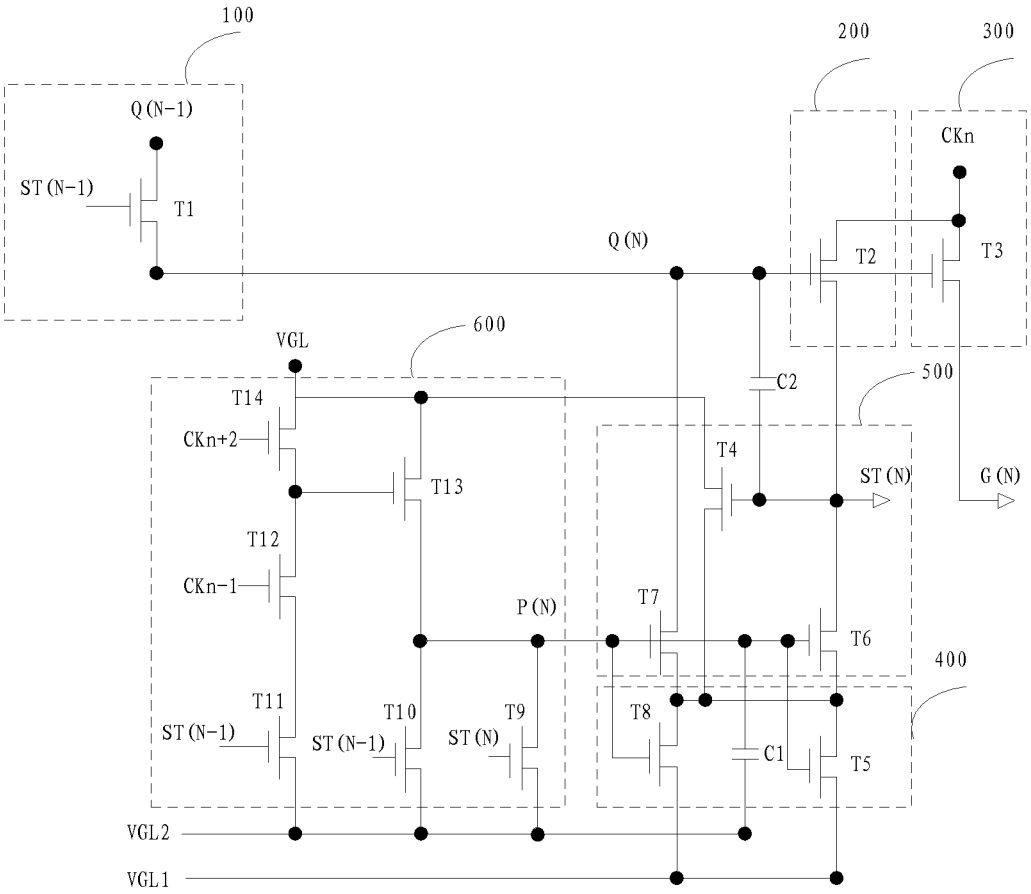
FIG. 2 is a circuit diagram of the GOA circuit structure illustrated in FIG. 1 according to the first embodiment of the present invention.

FIG. 2 is a circuit diagram of the GOA circuit structure illustrated in FIG. 1 according to the first embodiment of the present invention. As illustrated in FIG. 2, the Nth level COA unit 11 includes a pull-up control module 100, a pull-down module 200, a pull-up module 300, pull-down holding module 400, a leakage control module 500 and a pull-down module 600.

The pull-up control module 100 includes a first transistor T1, the gate terminal of the first transistor T1 is connected to the N−1th level pull-down signal. The drain terminal of the first transistor T1 is connected to the first leakage control signal. The source terminal of the first transistor T1 is connected to the Nth levelgate terminal signalQ (N). In this embodiment, the first leakage control signal is the N−1th levelgate terminal signalQ (N−1). Wherein in the valid period of the Nth level scanning signalG (N), the N−1th levelgate terminal signal is in high electric potential to make the drain terminal of the first transistor T1 in high electric potential and the Vgs of the first transistor T1 small than 0 to block the leakage pathway of the Nth levelgate terminal signalQ (N) through the first transistor T1.

The pull-down module 200 includes a second transistor T2. The gate terminal of the second transistor T2 is connected to the Nth levelgate terminal signalQ (N), the drain terminal of the second transistor T2 is connected to the Nth level clock signal line CKn, and the source terminal of the second transistor T2 outputs the Nth level pull-down signal ST (N).

The pull-up module 300 includes a third transistor T3, the gate terminal of the third transistor T3 is connected to the Nth levelgate terminal signalQ (N), the drain terminal of the third transistor T3 is connected to the Nth level clock signal line CKn, and the source terminal of the third transistor T3 output the Nth level scanning signal G (N).

The pull-down holding module 400 includes a fifth transistor T5 and a eighth transistor T8. The gate terminal of the fifth transistor T5 is connected to the Nth level common signalP (N), the drain terminal of the fifth transistor T5 is connected to the Nth level pull-down signal ST (N), the source terminal of the fifth transistor T5 is connected to a first low direct current voltage source (VGL1). The gate terminal of the eighth transistor T8 is connected to the Nth level common signalP (N), the source terminal of the eighth transistor T8 is connected to the first low direct current voltage source (VGL1) and the drain terminal of the eighth transistor T8 is connected to the Nth levelgate terminal signalQ (N).

Wherein in the valid period of the Nth level scanning signal G (N), because of the Vgs of the fifth transistor T5 is equal to 0, the Nth level pull-down signal ST (N) is leakage through the fifth transistor T5, and the Nth level pull-down signal ST (N) cannot reach the high electric level. In the meantime, because of the Vgs of the eighth transistor T8 is equal to 0, the Nth levelgate terminal signalQ (N) is leakage through the eighth transistor T8, and the Nth levelgate terminal signalQ (N) cannot reach the high electric level.

In order to solve the problem mentioned above, the leakage control module 500 is connected in series between the pull-down holding circuits 400, the Nth level pull-down signal ST (N) and the Nth level gate terminal signal Q (N). By the second leakage control signal to block the Nth level gate terminal signal Q (N) through the leakage pathway of the eighth transistor T8 and the Nth level pull-down signal ST (N) through the leakage pathway of the fifth transistor T5.

To more specific, the leakage control module 500 includes a fourth transistor T4, a sixth transistor T6 and a seventh transistor T7. The gate terminal of the fourth transistor T4 is connected to the second leakage control signal, the drain terminal of the fourth transistor T4 is connected to the direct current signaling source VGL, the source terminal of the fourth transistor T4 is connected to the drain terminal of the eighth transistor T8, the sixth transistor T6 is connected between the Nth level pull-down signal ST (N) and the drain terminal of the fifth transistor T5. The gate terminal of the sixth transistor T6 is connected to the Nth level common signalP (N), the drain terminal of the sixth transistor T6 is connected to the Nth level pull-down signal ST (N). The source terminal of the sixth transistor T6 is connected to the drain terminal of the fifth transistor T5 and the source terminal of the fourth transistor T4. The seventh transistor T7 is connected between the Nth levelgate terminal signalQ (N) and the drain terminal of the eighth transistor T8. The gate terminal of the seventh transistor T7 is connected to the Nth level common signalP (N), the drain terminal of the seventh transistor T7 is connected to the Nth levelgate terminal signalQ (N) and the source terminal of the seventh transistor T7 is connected to the drain terminal of the eighth transistor T8. In this embodiment, the second leakage control signal is a Nth level pull-down signal ST (N).

Wherein in the valid period of the Nth level scanning signal G (N), the Nth level clock signal line CKn is from low electric level to high electric level. The Nth level pull-down signal ST (N) and the Nth levelgate terminal signalQ (N) is output in a high electric level. The Nth level pull-down signal ST (N) and the Nth level gate terminal signal Q (N) is output in a high electric level. The drain terminals of the sixth transistor T6 and the seventh transistor T7 is effected by the fourth transistor T4 to a high electric level and the Vgs of the sixth transistor T6 and the seventh transistor T7 is smaller than 0 to block the Nth levelgate terminal signalQ (N) of the leakage pathway through the eighth transistor T8 and the Nth level pull-down signal ST (N) of the leakage pathway through the fifth transistor T5.

Those skilled in the art can understand, in the embodiment, the leakage control module 500 includes the fourth transistor T4, the sixth transistor T6 and the seventh transistor T7 to block the Nth levelgate terminal signalQ (N) of the leakage pathway through the eighth transistor T8 and the Nth level pull-down signal ST (N) of the leakage pathway through the fifth transistor T5. In other embodiment, the leakage control module 500 can only include the fourth transistor T4 and the sixth transistor T6 to block the Nth levelgate terminal signalQ (N) of the leakage pathway through the fifth transistor T5. Besides the leakage control module 500 can only include the fourth transistor T4 and the seventh transistor T7 to block the Nth levelgate terminal signalQ (N) of the leakage pathway through the eighth transistor T8.

The pull-down circuit 600 includes a ninth transistor T9, a tenth transistor T10, an eleventh transistor T11, a twelfth transistor T12, a thirteenth transistor T13 and a fourteenth transistor T14. Wherein the gate terminal of the ninth transistor T9 is connected to the Nth pull-down signal ST (N), the source terminal of the ninth transistor T9 is connected to the a second low direct current voltage source (VGL2). The drain terminal of the ninth transistor T9 is connected to the Nth level common signal P (N), the gate terminal of the tenth transistor T10 is connected to the N−1th level pull-down signal ST (N−1), the source terminal of the tenth transistor T10 is connected to the second low direct current voltage source (VGL2), the drain terminal of the tenth transistor T10 is connected to the Nth level common signal P (N). The gate terminal of the eleventh transistor T11 is connected to the N−1th level pull-down signal ST (N−1), the source terminal of the eleventh transistor T11 is connected to the second low direct current voltage source (VGL2). The drain terminal of the eleventh transistor T11 is connected to the source terminal of the twelfth transistor T12, the gate terminal of the twelfth transistor T12 is connected to the N−1th level clock signal line CKn-1. The drain terminal of the twelfth transistor T12 is connected to the gate terminal of the thirteenth transistor T13 and the source terminal of the fourteenth transistor T14, the source terminal of the thirteenth transistor T13 is connected to the Nth level common signal P (N), the drain terminals of the thirteenth transistor T13 and the fourteenth transistor T14 are connected to the direct current signaling source VGL, the gate terminal of the fourteenth transistor T14 is connected to the N+2th level clock signal line CKn+2.

In this embodiment, the electric potential of the first low direct current voltage source (VGL1) is smaller than the electric potential of the second low direct current voltage source (VGL2). The lower electric potential of the N−1th level pull-down signal ST (N-1), the Nth level pull-down signal ST (N) are smaller than the electric potential of the of the second low direct current voltage source (VGL2) and makes the Nth level pull-down signal ST (N) in an invalid period and the Nth level common signal P (N) in the high electric potential period, the Vgs of the ninth transistor T9, the tenth transistor T10, the eleventh transistor T11 are smaller than 0 to block the leakage pathway of the Nth common signal P (N) through the ninth transistor T9, the tenth transistor T10, the eleventh transistor T11 to maintain the Nth common signal P (N) in a high electric potential.

In this embodiment, when the Nth level clock signal line CKn is in first clock signal CK1, the N+2th level clock signal line CKn+2 is in third clock signal CK3, the N−1th level clock signal line CKn-1 is in fourth clock signal CK4.

In one preferred embodiment, the Nth level GOA unit 11 further includes a filter capacitor C1 and a bootstrap capacitor C2. One terminal of the filter capacitor C1 is connected to the Nth level common signal P (N), another terminal of the filter capacitor C1 is connected to the second low direct current voltage source (VGL2). One terminal of the bootstrap capacitor C2 is connected to the Nth level gate terminal signal Q (N), another terminal of the bootstrap capacitor C2 is connected to the Nth level pull-down signal ST (N).

Figure 3:
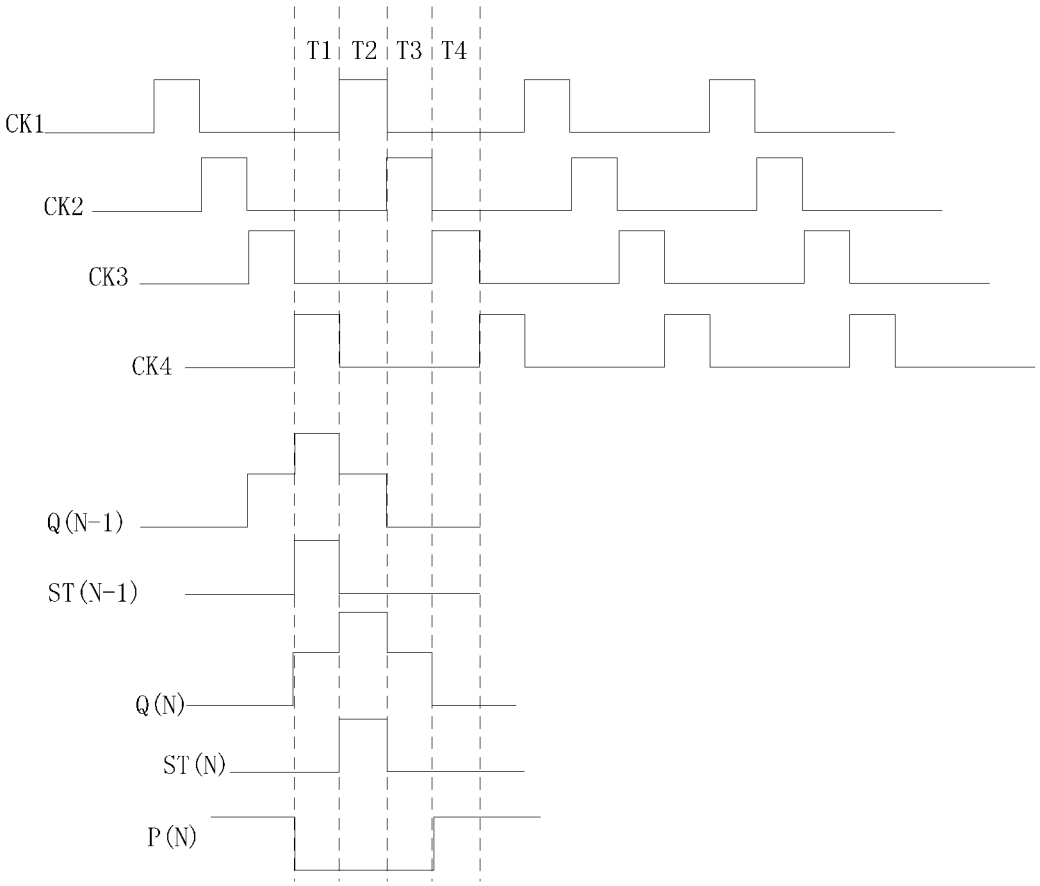
FIG. 3 is a timing diagram of the GOA circuit structure illustrated in FIG. 1 according to the first embodiment of the present invention.

Referring to FIG. 3, it is a timing diagram of the GOA circuit structure. As illustrated in FIG. 3, the valid period of the Nth level GOA includes:

In the T1 stage, the N−1th level pull-down signal ST (N-1) and the N−1 gate terminal signal Q (N-1) is in high electric potential, the first transistor T1, the second transistor T2 and the third transistor T3 are open and make the Nth levelgate terminal signalQ (N) in high electric potential. The tenth transistor T10, the eleventh transistor T11 and the twelfth transistor T12 are open, and the thirteenth transistor T13 is close to make the Nth level common signal P (N) in a low electric potential.

In the T2 stage, the Nth level clock signal line CKn so as the first clock signal CK1 is from a low electric potential to a high electric potential, the Nth level pull-down signal ST (N) output a high electric potential to drive the N+1 GOA unit, and the Nth levelgate terminal signalQ (N) output a high electric potential to charge the Nth level horizontal scanning line in the corresponding display zone. In the meantime, the drain terminal of the first transistor T1 input the N−1 gate terminal signalQ (N-1) is in a high electric potential to make the Vgs of the first transistor T1 smaller than 0 to block the Nth levelgate terminal signalQ (N) from the leakage pathway of the first transistor T1. The drain terminals of the sixth transistor T6 and the seventh transistor T7 are in a high electric potential to make the Vgs of the sixth transistor T6 and the seventh transistor T7 smaller than 0 to block the Nth levelgate terminal signalQ (N) from the leakage pathway of the eighth transistor T8 and block the Nth level pull-down signal ST (N) from the leakage pathway of the fifth transistor T5.

In the T3 stage, the Nth level clock signal line CKn so as the first clock signal CK1 is from a high electric potential to a low electric potential. In the meantime, the Nth levelgate terminal signalQ (N) is in a high electric potential and the Nth level common P (N) in a low electric potential.

In the T4 stage, the N+2th level clock signal line CKn+2 so as the third clock signal CK3 is in a high electric potential, the thirteenth transistor T13 and the fourteenth transistor T14 are open and make the Nth level common signal P (N) in high electric potential. The fifth transistor T5, the sixth transistor T6, the seventh transistor T7 and the eighth transistor T8 are open to make the Nth level pull-down signal ST (N) and the Nth level common signal Q (N) in a low electric potential. In the meantime, the electric potential of the first low direct current voltage source (VGL1) is smaller than the electric potential of the second low direct current voltage source (VGL2). The lower electric potential of the N−1th level pull-down signal ST (N-1), the Nth level pull-down signal ST (N) are smaller than the electric potential of the of the second low direct current voltage source (VGL2) and makes the Vgs of the ninth transistor T9, the tenth transistor T10 and the eleventh transistor T11 are smaller than 0 to block the leakage pathway of the Nth level common signal P (N) through the ninth transistor T9, the tenth transistor T10 and the eleventh transistor T11.

Figure 4:
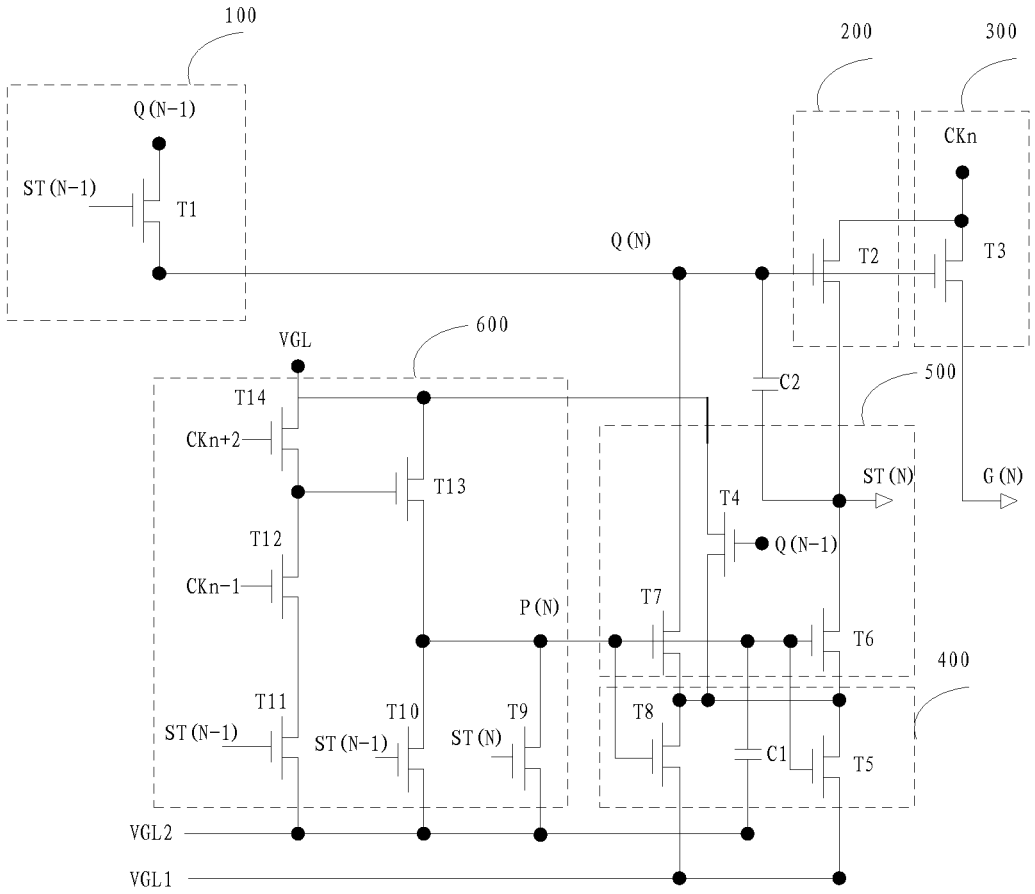
FIG. 4 is a circuit diagram of the GOA circuit structure illustrated in FIG. 1 according to the second embodiment of the present invention.

FIG. 4 is a circuit diagram of the GOA circuit structure illustrated in FIG. 1 according to the second embodiment of the present invention. As the second embodiment illustrated in FIG. 4, the difference between the first embodiments illustrated in FIG. 2 is as followed. The gate terminal of the fourth transistor T4 illustrated in FIG. 4 is connected to the N−1th level gate terminal signal Q (N-1) and the gate terminal of the fourth transistor T4 illustrated in FIG. 2 is connected to the Nth level pull-down signal ST (N).

Wherein in the T1 stage illustrated in FIG. 3, since the N−1th level gate terminal signal Q (N-1) connected to the gate terminal of the fourth transistor T4 is in a high electric potential to make the Vgs of the seventh transistor T7 smaller than 0 and the Nth levelgate terminal signalQ (N) becomes a high electric potential to block the leakage pathway through the Nth levelgate terminal signalQ (N) usually.

Figure 5:
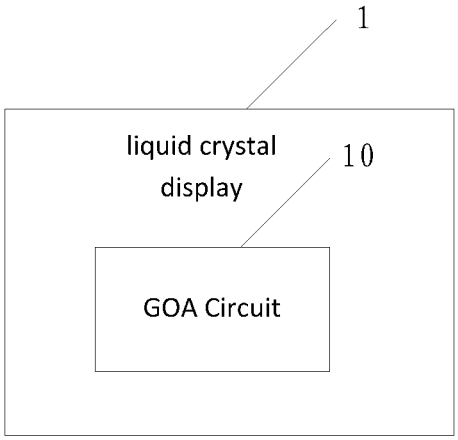
FIG. 5 is a schematic view illustrating the liquid crystal display structure according to the embodiment of the present invention.

FIG. 5 is a schematic view illustrating the liquid crystal display structure according to the embodiment of the present invention. As illustrated in FIG. 5, the liquid crystal display structure includes the GOA circuit 10 mentioned above.

The advantage of this application is by adding the leakage control module between the Nth level gate terminal signal and the eighth transistor T8 and/or the Nth level pull-down signal and the fifth transistor T5 into the GOA circuit and the liquid crystal display structure to achieving of leakage blocking. In the valid period of the Nth level scanning signal, the Nth level gate terminal signal through the leakage pathway from the eighth transistor T8 and/or the leakage pathway through the Nth level pull-down signal through the fifth transistor T5 is blocked and enhance the stability of the GOA circuit.

It will be apparent to those having ordinary skill in the art that various modifications and variations can be made to the devices in accordance with the present disclosure without departing from the scope or spirit of the disclosure. In view of the foregoing, it is intended that the present disclosure covers modifications and variations of this disclosure provided they fall within the scope of the following claims and their equivalents.

Although the drawings and the illustrations above are corresponding to the specific embodiments individually, the element, the practicing method, the designing principle, and the technical theory can be referred, exchanged, incorporated, collocated, coordinated except they are conflicted, incompatible, or hard to be put into practice together.

Although the present application has been explained above, it is not the limitation of the range, the sequence in practice, the material in practice, or the method in practice. Any modification or decoration for present application is not detached from the spirit and the range of such.

What is claimed is:

1. A GOA circuit for liquid crystal display, the GOA circuit comprising a plurality of GOA unit connected in series, wherein a Nth level GOA unit including a pull-up control module, a pull-down module, a pull-up module, a pull-down holding module and a leakage control module;

wherein the pull-up control module including a first transistor, a gate terminal of the first transistor is connected to a N−1th level pull-down signal, a drain terminal of the first transistor is connected to the first leakage control signal and the source terminal of the first transistor is connected to the Nth levelgate terminal signal;

wherein the pull-down module including a second transistor, the gate terminal of the second transistor is connected to the Nth levelgate terminal signal, the drain terminal of the second transistor is connected to the Nth level clock signal line, and the source terminal of the second transistor output the Nth level pull-down signal;

wherein the pull-up module including a third transistor, the gate terminal of the third transistor is connected to the Nth levelgate terminal signal, the drain terminal of the third transistor is connected to the Nth level clock signal line, and the source terminal of the third transistor output the Nth level scanning signal;

wherein the pull-down holding module including a fifth transistor and a eighth transistor, the gate terminal of the fifth transistor is connected to the Nth level common signal, the drain terminal of the fifth transistor is connected to the Nth level pull-down signal, the source terminal of the fifth transistor is connected to a first low direct current voltage source; and the gate terminal of the eighth transistor is connected to the Nth level common signal, the source terminal of the eighth transistor is connected to the first low direct current voltage source and the drain terminal of the eighth transistor is connected to the Nth levelgate terminal signal;

wherein the leakage control module is connected in series between the Nth level gate terminal signal and the eighth transistor and/or between the Nth level pull-down signal and the fifth transistor; in the valid period of the Nth level scanning signal, a second leakage control signal is to block the Nth level gate terminal signal through the leakage pathway of the eighth transistor and/or to block the Nth level pull-down signal through the leakage pathway of the fifth transistor;

wherein the leakage control module further including a fourth transistor and a seventh transistor, the gate terminal of the fourth transistor is connected to the second leakage control signal, the drain terminal of the fourth transistor is connected to the direct current signaling source, the source terminal of the fourth transistor is connected to the drain terminal of the eighth transistor; the seventh transistor is connected between the Nth levelgate terminal signal and the drain terminal of the eighth transistor, the gate terminal of the seventh transistor is connected to the Nth level common signal, the drain terminal of the seventh transistor is connected to the Nth levelgate terminal signal and the source terminal of the seventh transistor is connected to the drain terminal of the eighth transistor to block the Nth levelgate terminal signal through the leakage pathway of the eighth transistor in the valid period of the Nth level scanning signal;

wherein the first leakage control signal is the N−1th level gate terminal signal and to block the Nth levelgate terminal signal through the leakage pathway of the first transistor in the valid period of the Nth level scanning signal.

2. The GOA circuit according to claim 1, wherein the second leakage control signal is the Nth level pull-down signal.

3. A GOA circuit for liquid crystal display, the GOA circuit comprising a plurality of GOA unit connected in series, wherein a Nth level GOA unit including a pull-up control module, a pull-down module, a pull-up module, a pull-down holding module and a leakage control module;

wherein the pull-up control module including a first transistor, a gate terminal of the first transistor is connected to a N−1th level pull-down signal, a drain terminal of the first transistor is connected to the first leakage control signal and the source terminal of the first transistor is connected to the Nth levelgate terminal signal;

wherein the pull-down module including a second transistor, the gate terminal of the second transistor is connected to the Nth levelgate terminal signal, the drain terminal of the second transistor is connected to the Nth level clock signal line, and the source terminal of the second transistor output the Nth level pull-down signal;

wherein the pull-up module including a third transistor, the gate terminal of the third transistor is connected to the Nth levelgate terminal signal, the drain terminal of the third transistor is connected to the Nth level clock signal line, and the source terminal of the third transistor output the Nth level scanning signal;

wherein the pull-down holding module including a fifth transistor and a eighth transistor, the gate terminal of the fifth transistor is connected to the Nth level common signal, the drain terminal of the fifth transistor is connected to the Nth level pull-down signal, the source terminal of the fifth transistor is connected to a first low direct current voltage source; and the gate terminal of the eighth transistor is connected to the Nth level common signal, the source terminal of the eighth transistor is connected to the first low direct current voltage source and the drain terminal of the eighth transistor is connected to the Nth levelgate terminal signal;

wherein the leakage control module is connected in series between the Nth level gate terminal signal and the eighth transistor and/or between the Nth level pull-down signal and the fifth transistor; in the valid period of the Nth level scanning signal, a second leakage control signal is to block the Nth level gate terminal signal through the leakage pathway of the eighth transistor and/or to block the Nth level pull-down signal through the leakage pathway of the fifth transistor.

4. The GOA circuit according to claim 3, wherein the leakage control module further including a fourth transistor and a seventh transistor, the gate terminal of the fourth transistor is connected to the second leakage control signal, the drain terminal of the fourth transistor is connected to the direct current signaling source, the source terminal of the fourth transistor is connected to the drain terminal of the eighth transistor; the seventh transistor is connected between the Nth levelgate terminal signal and the drain terminal of the eighth transistor, the gate terminal of the seventh transistor is connected to the Nth level common signal, the drain terminal of the seventh transistor is connected to the Nth levelgate terminal signal and the source terminal of the seventh transistor is connected to the drain terminal of the eighth transistor to block the Nth levelgate terminal signal through the leakage pathway of the eighth transistor in the valid period of the Nth level scanning signal.

5. The GOA circuit according to claim 4, wherein the second leakage control signal is the Nth level pull-down signal.

6. The GOA circuit according to claim 4, wherein the second leakage control signal is the N−1th level gate terminal signal.

7. The GOA circuit according to claim 4, wherein the leakage control module further comprising a sixth transistor, wherein the sixth transistor is connected between the Nth level pull-down signal and the drain terminal of the fifth transistor, the gate terminal of the sixth transistor is connected to the Nth level common signal, the drain terminal of the sixth transistor is connected to the Nth level pull-down signal, the source terminal of the sixth transistor is connected to the drain terminal of the fifth transistor and the source terminal of the fourth transistor to block the Nth level pull-down signal through the leakage pathway of the fifth transistor in the valid period of the Nth level scanning signal.

8. The GOA circuit according to claim 3, wherein the first leakage control signal is the N−1th level gate terminal signal to block the Nth levelgate terminal signal through the leakage pathway of the first transistor in the valid period of the Nth level scanning signal.

9. The GOA circuit according to claim 3, wherein the Nth level GOA unit further comprising a pull-down module, the pull-down module comprising a ninth transistor, a tenth transistor, an eleventh transistor, a twelfth transistor, a thirteenth transistor and a fourteenth transistor; wherein the gate terminal of the ninth transistor is connected to the Nth level pull-down signal, the source terminal of the ninth transistor is connected to the a second low direct current voltage source, the drain terminal of the ninth transistor is connected to the Nth level common signal, the gate terminal of the tenth transistor is connected to the N−1th level pull-down signal, the source terminal of the tenth transistor is connected to the second low direct current voltage source, the drain terminal of the tenth transistor is connected to the Nth level common signal, the gate terminal of the eleventh transistor is connected to the N−1th level pull-down signal, the source terminal of the eleventh transistor is connected to the second low direct current voltage source, the drain terminal of the eleventh transistor is connected to the source terminal of the twelfth transistor, the gate terminal of the twelfth transistor is connected to the N−1th level clock signal line, the drain terminal of the twelfth transistor is connected to the gate terminal of the thirteenth transistor and the source terminal of the fourteenth transistor, the source terminal of the thirteenth transistor is connected to the Nth level common signal, the drain terminals of the thirteenth transistor and the fourteenth transistor are connected to the direct current signaling source, the gate terminal of the fourteenth transistor is connected to the N+2th level clock signal line.

10. The GOA circuit according to claim 9, wherein the electric potential of the first low direct current voltage source is smaller than the electric potential of the second low direct current voltage source, the lower electric potential of the N−1th level pull-down signal, the Nth level pull-down signal are smaller than the electric potential of the of the second low direct current voltage source to block the leakage pathway of the Nth level common signal through the ninth transistor, the tenth transistor, the eleventh transistor in the invalid period of the Nth level scanning signal.

11. The GOA circuit according to claim 9, the Nth level GOA unit received a first clock signal, a second clock signal, a third clock signal, and a fourth clock signal, and the first clock signal, the second clock signal, the third clock signal, and the fourth clock signal CK4 are timely valid in orderly during one working period, wherein when the Nth level clock signal line is the first clock signal, the N+2 clock signal line is the third clock signal and the N−1 clock signal line is the fourth clock signal.

12. A liquid crystal display having a GOA circuit, the GOA circuit comprising a plurality of GOA unit connected in series, wherein a Nth level GOA unit including a pull-up control module, a pull-down module, a pull-up module, a pull-down holding module and a leakage control module;

wherein the pull-up control module including a first transistor, a gate terminal of the first transistor is connected to a N−1th level pull-down signal, a drain terminal of the first transistor is connected to the first leakage control signal and the source terminal of the first transistor is connected to the Nth levelgate terminal signal;

wherein the pull-down module including a second transistor, the gate terminal of the second transistor is connected to the Nth levelgate terminal signal, the drain terminal of the second transistor is connected to the Nth level clock signal line, and the source terminal of the second transistor output the Nth level pull-down signal;

wherein the pull-up module including a third transistor, the gate terminal of the third transistor is connected to the Nth levelgate terminal signal, the drain terminal of the third transistor is connected to the Nth level clock signal line, and the source terminal of the third transistor output the Nth level scanning signal;

wherein the pull-down holding module including a fifth transistor and a eighth transistor, the gate terminal of the fifth transistor is connected to the Nth level common signal, the drain terminal of the fifth transistor is connected to the Nth level pull-down signal, the source terminal of the fifth transistor is connected to a first low direct current voltage source; and the gate terminal of the eighth transistor is connected to the Nth level common signal, the source terminal of the eighth transistor is connected to the first low direct current voltage source and the drain terminal of the eighth transistor is connected to the Nth levelgate terminal signal;

wherein the leakage control module is connected in series between the Nth level gate terminal signal and the eighth transistor and/or between the Nth level pull-down signal and the fifth transistor; in the valid period of the Nth level scanning signal, a second leakage control signal is to block the Nth level gate terminal signal through the leakage pathway of the eighth transistor and/or to block the Nth level pull-down signal through the leakage pathway of the fifth transistor.

13. The liquid crystal display according to claim 12, wherein the leakage control module further including a fourth transistor and a seventh transistor, the gate terminal of the fourth transistor is connected to the second leakage control signal, the drain terminal of the fourth transistor is connected to the direct current signaling source, the source terminal of the fourth transistor is connected to the drain terminal of the eighth transistor; the seventh transistor is connected between the Nth levelgate terminal signal and the drain terminal of the eighth transistor, the gate terminal of the seventh transistor is connected to the Nth level common signal, the drain terminal of the seventh transistor is connected to the Nth levelgate terminal signal and the source terminal of the seventh transistor is connected to the drain terminal of the eighth transistor to block the Nth levelgate terminal signal through the leakage pathway of the eighth transistor in the valid period of the Nth level scanning signal.

14. The liquid crystal display according to claim 13, wherein the second leakage control signal is the Nth level pull-down signal.

15. The liquid crystal display according to claim 13, wherein the second leakage control signal is the N−1th level gate terminal signal.

16. The liquid crystal display according to claim 13, wherein the leakage control module further comprising a sixth transistor, wherein the sixth transistor is connected between the Nth level pull-down signal and the drain terminal of the fifth transistor, the gate terminal of the sixth transistor is connected to the Nth level common signal, the drain terminal of the sixth transistor is connected to the Nth level pull-down signal, the source terminal of the sixth transistor is connected to the drain terminal of the fifth transistor and the source terminal of the fourth transistor to block the Nth level pull-down signal through the leakage pathway of the fifth transistor in the valid period of the Nth level scanning signal.

17. The liquid crystal display according to claim 12, wherein the first leakage control signal is the N−1th level gate terminal signal to block the Nth levelgate terminal signal through the leakage pathway of the first transistor in the valid period of the Nth level scanning signal.

18. The liquid crystal display according to claim 12, wherein the Nth level GOA unit further comprising a pull-down module, the pull-down module comprising a ninth transistor, a tenth transistor, an eleventh transistor, a twelfth transistor, a thirteenth transistor and a fourteenth transistor; wherein the gate terminal of the ninth transistor is connected to the Nth level pull-down signal, the source terminal of the ninth transistor is connected to the a second low direct current voltage source, the drain terminal of the ninth transistor is connected to the Nth level common signal, the gate terminal of the tenth transistor is connected to the N−1th level pull-down signal, the source terminal of the tenth transistor is connected to the second low direct current voltage source, the drain terminal of the tenth transistor is connected to the Nth level common signal, the gate terminal of the eleventh transistor is connected to the N−1th level pull-down signal, the source terminal of the eleventh level transistor is connected to the second low direct current voltage source, the drain terminal of the eleventh transistor is connected to the source terminal of the twelfth transistor, the gate terminal of the twelfth transistor is connected to the N−1th level clock signal line, the drain terminal of the twelfth transistor is connected to the gate terminal of the thirteenth transistor and the source terminal of the fourteenth transistor, the source terminal of the thirteenth transistor is connected to the Nth level common signal, the drain terminals of the thirteenth transistor and the fourteenth transistor are connected to the direct current signaling source, the gate terminal of the fourteenth transistor is connected to the N+2th level clock signal line.

19. The liquid crystal display according to claim 18, wherein the electric potential of the first low direct current voltage source is smaller than the electric potential of the second low direct current voltage source, the lower electric potential of the N−1th level pull-down signal, the Nth level pull-down signal are smaller than the electric potential of the of the second low direct current voltage source to block the leakage pathway of the Nth level common signal through the ninth transistor, the tenth transistor, the eleventh transistor in the invalid period of the Nth level scanning signal.

20. The liquid crystal display according to claim 18, the Nth level GOA unit received a first clock signal, a second clock signal, a third clock signal, and a fourth clock signal, and the first clock signal, the second clock signal, the third clock signal, and the fourth clock signal CK4 are timely valid in orderly during one working period, wherein when the Nth level clock signal line is the first clock signal, the N+2 clock signal line is the third clock signal and the N−1 clock signal line is the fourth clock signal.

* * * * *